United States Patent [19]

Kogiso

[11] 4,369,621

[45] Jan. 25, 1983

[54] METHOD FOR SIMULTANEOUSLY CHANGING BOBBINS IN A FLY FRAME AND APPARATUS FOR CARRYING OUT THE METHOD

[75] Inventor: Takashi Kogiso, Mizunami, Japan

[73] Assignee: Howa Kogyo Kabushiki Kaisha, Nagoya, Japan

[21] Appl. No.: 323,703

[22] Filed: Nov. 20, 1981

[30] Foreign Application Priority Data

Nov. 20, 1980 [JP] Japan ..... 55-164281

[51] Int. Cl.[3] ..... D01H 9/08

[52] U.S. Cl. ..... 57/267; 57/274

[58] Field of Search ..... 57/266, 267, 273, 274

[56] References Cited

U.S. PATENT DOCUMENTS

| | | | |
|---|---|---|---|
| 3,344,593 | 10/1967 | Morikawa et al. | 57/267 |
| 3,681,905 | 8/1972 | Furtmeier et al. | 57/267 X |
| 3,905,184 | 9/1975 | Takai et al. | 57/274 |
| 3,935,699 | 2/1976 | Iida et al. | 57/267 |
| 4,324,094 | 4/1982 | Cicerone | 57/267 |

FOREIGN PATENT DOCUMENTS

| | | | |
|---|---|---|---|
| 51-34008 | 9/1976 | Japan | 57/267 |

*Primary Examiner*—John Petrakes

*Attorney, Agent, or Firm*—Armstrong, Nikaido, Marmelstein & Kubovcik

[57] ABSTRACT

A method and an apparatus for simultaneously changing bobbins in a fly frame wherein flyers supported from above are arranged in a zigzag fashion in front and back rows. The method comprises supplying empty bobbins in a zigzag fashion on pegs mounted on a conveyor of a bobbin changing apparatus; advancing bobbin changing arms of the bobbin changing apparatus to full bobbins on the fly frame; simultaneously doffing the full bobbins; retracting the arms with the full bobbins while the conveyor is moved so as to pass the full bobbins through spaces between adjacent empty bobbins; inserting the full bobbins onto empty pegs of the conveyor; moving the conveyor to locate the empty bobbins at positions corresponding to the arms; advancing and lifting the arms to remove the empty bobbins from the pegs; further advancing the arms with the empty bobbins while the conveyor is moved so as to pass the empty bobbins through spaces between adjacent full bobbins on the conveyor; donning the empty bobbins on the fly frame; and retracting the arms.

13 Claims, 39 Drawing Figures

METHOD FOR SIMULTANEOUSLY CHANGING BOBBINS IN A FLY FRAME AND APPARATUS FOR CARRYING OUT THE METHOD

BACKGROUND OF THE INVENTION

The present invention relates to a method for simultaneously doffing full bobbins and subsequently donning empty bobbins simultaneously in a fly frame wherein flyers supported from above are arranged in a zigzag fashion in front and back rows extending in the longitudinal direction of the fly frame, and it relates to an apparatus for carrying out the method.

Recently, flyers made of light metal or flyers supported from above have been used in a fly frame, and as a result, a speeding-up of the winding was realized and the amount of roving wound on a bobbin tube was increased. To further enhance the production efficiency in the fly frame, various methods and apparatuses for automatically doffing full bobbins have been proposed. Especially, it has been urged to automatically doff and donn all the bobbins in a fly frame simultaneously.

Japanese Patent Publication No. 34008/76 discloses an apparatus for simultaneously changing bobbins in a fly frame, wherein full bobbins are doffed from the fly frame and are placed on an appropriate transporting means, such as a conveyor, and then the full bobbins are discharged from the conveyor by moving said conveyor.

However, no conventional bobbin changing apparatus. which can simultaneously doff full bobbins, is able to automatically donn empty bobbins in a fly frame, i.e., to automatically supply empty bobbins onto a bobbin rail of the fly frame and to automatically have the empty bobbins supported by the flyers.

SUMMARY OF THE INVENTION

An object of the present invention is to provide a method for automatically changing bobbins, i.e., automatically doffing full bobbins and donning empty bobbins, in a fly frame.

Another object of the present invention is to provide a bobbin changing apparatus for doffing full bobbins and donning empty bobbins in a fly frame.

A further object of the present invention is to provide a bobbin changing apparatus which can be utilized as a footstool.

According to the present invention, there is provided a method for simultaneously changing bobbins in a fly frame wherein flyers supported from above are arranged in a zigzag fashion in front and back rows extending in the longitudinal direction of said fly frame, which method comprises: supplying empty bobbins in a zigzag fashion on pegs mounted on a conveyor of a bobbin changing apparatus before stoppage of said fly frame upon completion of full bobbins; advancing bobbin changing arms of said bobbin changing apparatus from a standby position thereof to full bobbins on the fly frame after the stoppage of said fly frame; simultaneously doffing said full bobbins by said bobbin changing arms; retracting said bobbin changing arms with said full bobbins and moving said conveyor so as to pass said full bobbins through spaces between adjacent empty bobbins; inserting said full bobbins onto empty pegs of the conveyor; moving said conveyor to locate said empty bobbins at positions corresponding to said bobbin changing arms; advancing said bobbin changing arms to remove said empty bobbins from said pegs; further advancing said arms with said empty bobbins toward the fly frame and moving said conveyor so as to pass said empty bobbins through spaces between adjacent full bobbins on the conveyor; donning said empty bobbins on said fly frame; and retracting said arms to said standby position.

Further, the present invention provides an apparatus for simultaneously changing bobbins in a fly frame, wherein flyers are arranged in a zigzag fashion in front and back rows extending in the longitudinal direction of said fly frame, which apparatus comprises: bobbin changing arms having bobbin supporting parts at the free ends thereof, said bobbin supporting parts being arranged in a zigzag fashion corresponding to said zigzag arranged flyers; a connecting member for supporting all of said bobbin changing arms; reciprocating means for horizontally reciprocating said connecting member towards said fly frame and therefrom; lifting means for lifting said connecting member; a conveyor located under said bobbin changing arms at a standby position and having two rows of pegs, half of said pegs being arranged corresponding to the zigzag arranged flyers, and the remaining pegs being equally and longitudinally shifted from half of said pegs a predetermined certain distance in one direction; conveyor moving means for moving said conveyor to and fro; means for controlling said lifting means; and means for controlling the cooperative movements of said reciprocating means with said conveyor moving means, so as to pass bobbins supported by said bobbin changing arms through spaces between adjacent bobbins mounted on said pegs of said conveyor.

The above and other objects, features and advantages of the present invention will become clear from the following particular description of the invention and the appended claims, taken in conjunction with the accompanying drawings which show, by way of example, a preferred embodiment of the present invention.

BRIEF DESCRIPTION OF THE DRAWINGS

A preferred embodiment of the present invention will now be explained with reference to the accompanying drawings, wherein.

DETAILED DESCRIPTION OF THE PREFERRED EMBODIMENT

Figure 1:
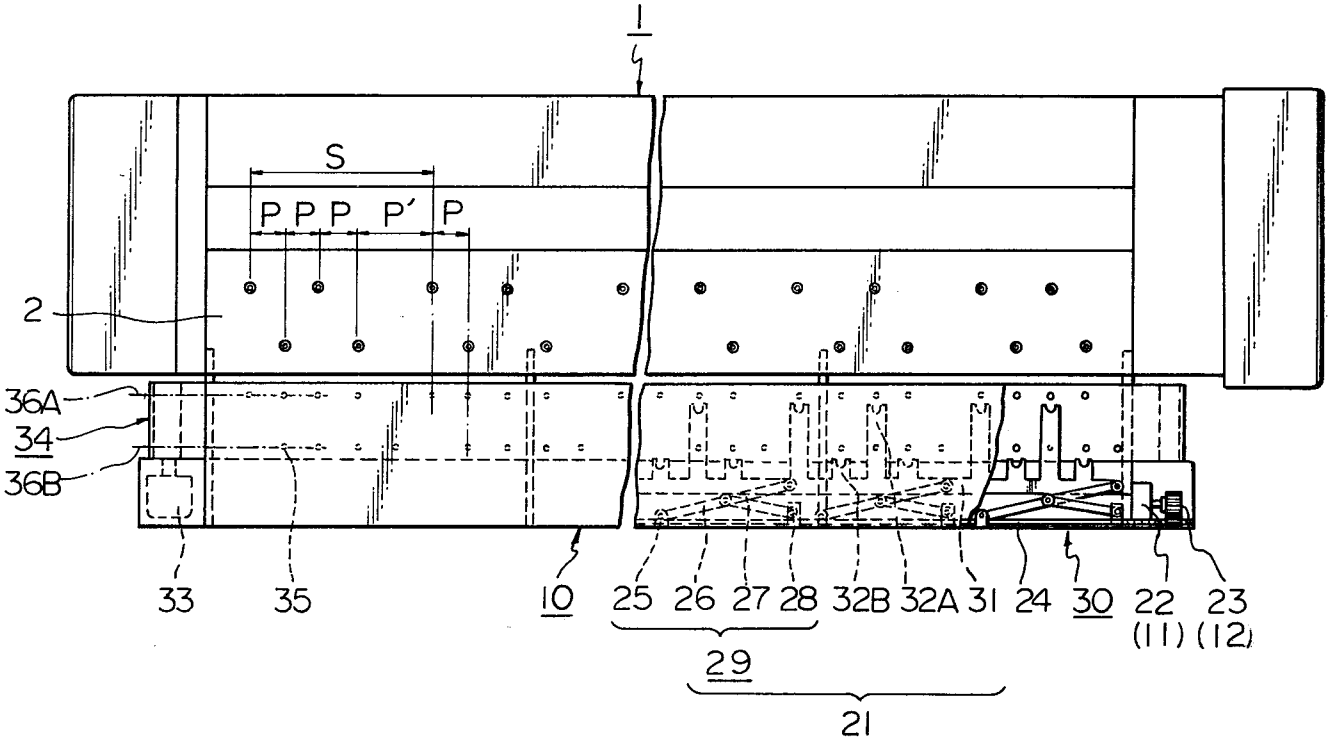
FIG. 1 is a plan view of a fly frame and an apparatus of the present invention for simultaneously changing bobbins mounted in the fly frame.
Figure 2:
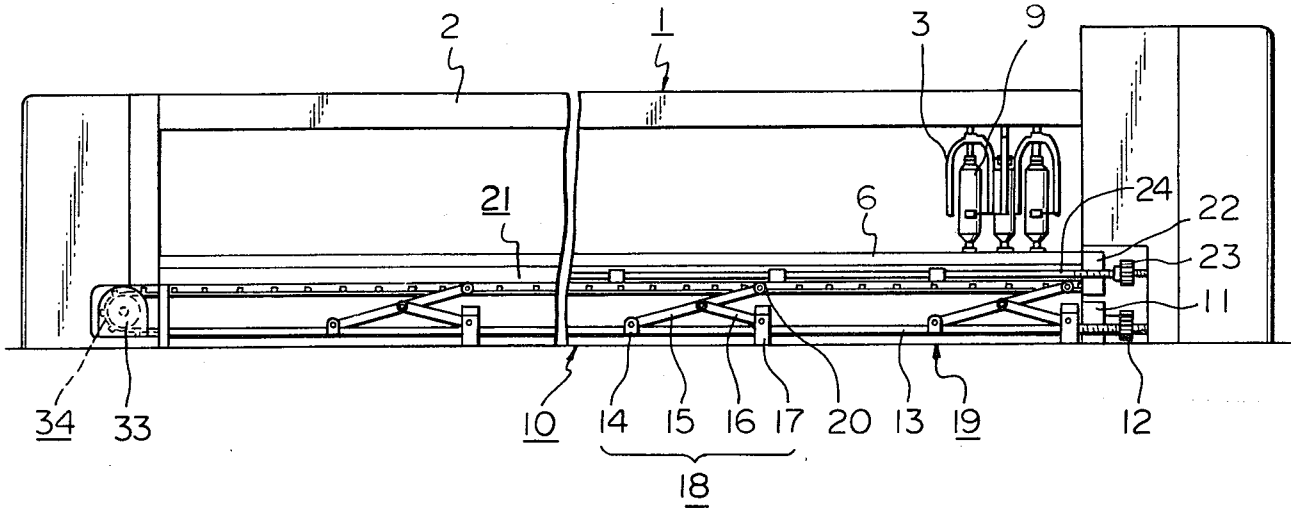
FIG. 2 is an elevation view of FIG. 1.
Figure 3:
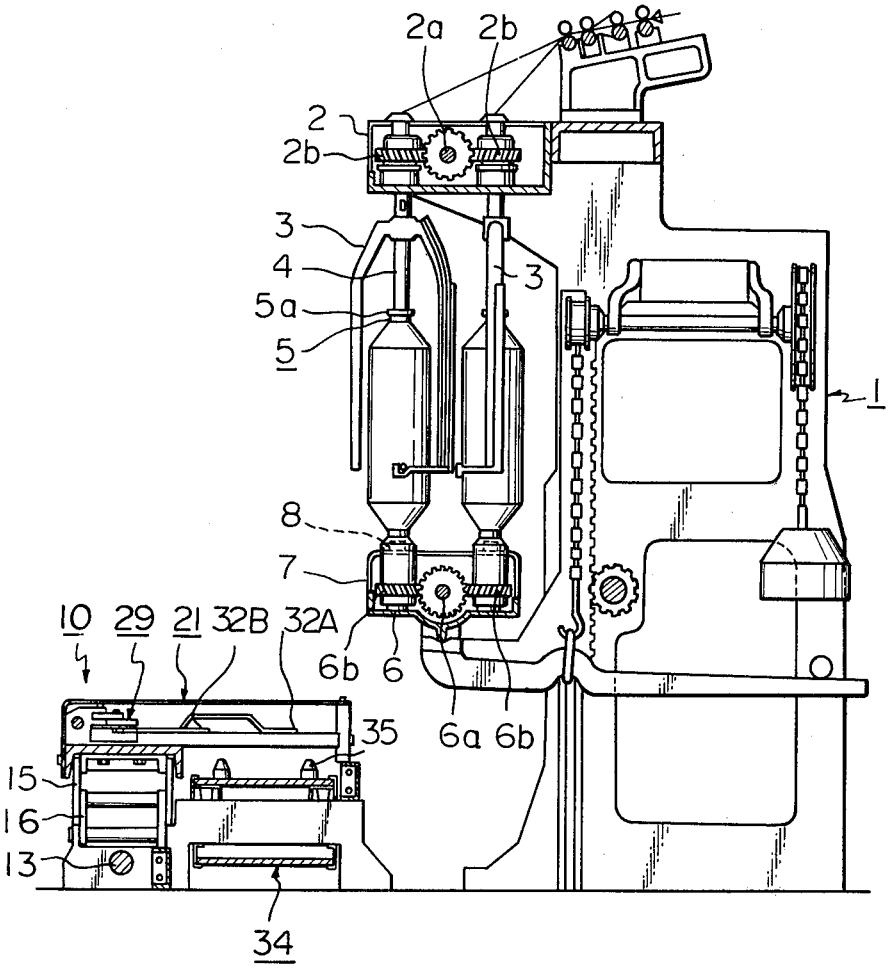
FIG. 3 is a side view of FIG. 1, wherein the fly frame is shown in a condition when the apparatus is being operated.
Figure 4:
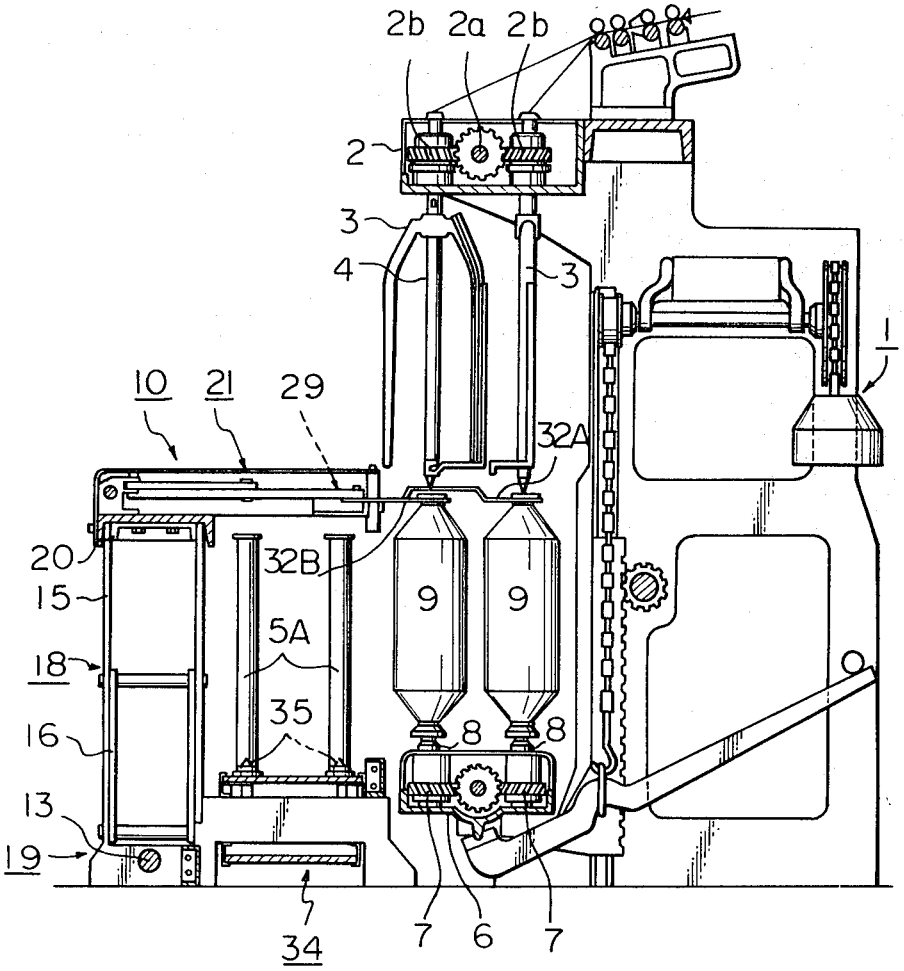
FIG. 4 is a side view of FIG. 1, wherein the bobbins wound in the fly frame are being changed.

As illustrated in FIGS. 1 through 4, reference numeral 1 denotes a fly frame having a top rail 2 at the upper portion thereof. The top rail 2 has flyers 3 supported from above and arranged in a zigzag fashion in front and back rows extending in the longitudinal direction of the fly frame 1. The fly frame 1 comprises a number of staffs S, and in each staff S several flyers 3 are arranged with certain pitches, P and P' as illustrated in FIG. 1. More specifically, four flyers 3 are arranged in a zigzag fashion in each staff S, with the two flyers 3 in each of the front or back row being spaced from each other by a distance 2P, and the flyers 3 positioned at the end of the staff S is apart from the adjacent flyer 3 belonging to another staff S by a distance 2P'. Intermediate frames (not shown) are disposed at every other staffs. As is known in this field, the flyers 3 are rotated at a high speed by means of a driving shaft 2*a* and gears 2*b* meshing with the driving shaft 2*a*, both shaft 2*a* and gear 2*b* being installed within the top rail 2 (FIGS. 3 and 4). Each of the flyers 3 has a bobbin guide leg 4 projecting downwardly from the center thereof and being capable of insertion into the upper portion of a hole formed in a bobbin tube for supporting the top of the bobbin during all the steps for winding a roving onto the bobbin. Beneath the flyers 3 suspended from the top rail 2, is arranged a bobbin rail 6 which moves vertically, i.e., lifts and lowers, in order to wind a roving on each bobbin tube. The bobbin rail 6 has bobbin wheels 7 arranged coaxially with the flyers 3 and installed therein, which bobbin wheels 7 are rotated at a high speed by means of a driving shaft 6*a* and gears 6*b* meshing with the shaft 6*a*. Reference numeral 8 denotes a projecting portion of each of the bobbin wheels 7 projecting from the upper surface of the bobbin rail 6. The lower portion of the hole formed in the bobbin 5 is inserted onto the projecting portion 8, and an engaging projection (not shown) formed on the projecting portion 8 is engaged with an engaging groove formed at the lower portion of the bobbin 5 in a conventionally known manner, so that the bobbin 5 can be rotated at a high speed together with the bobbin wheel 7. In short, the bobbin 5 is inserted into a space between the guide leg 4 of the flyer 3 and the projecting portion 8 of the wheel 7 and is supported from both above and below. As a result, the bobbin 5 is rotated at a high speed together with the bobbin wheel 7, and it is vertically moved as the bobbin rail 6 moves vertically. Accordingly, the roving which is twisted by the flyer 3 is wound in layers onto the bobbin to form a full bobbin of roving. The bobbin 5 of this embodiment has a flang 5*a* formed at the top thereof.

Figure 8:
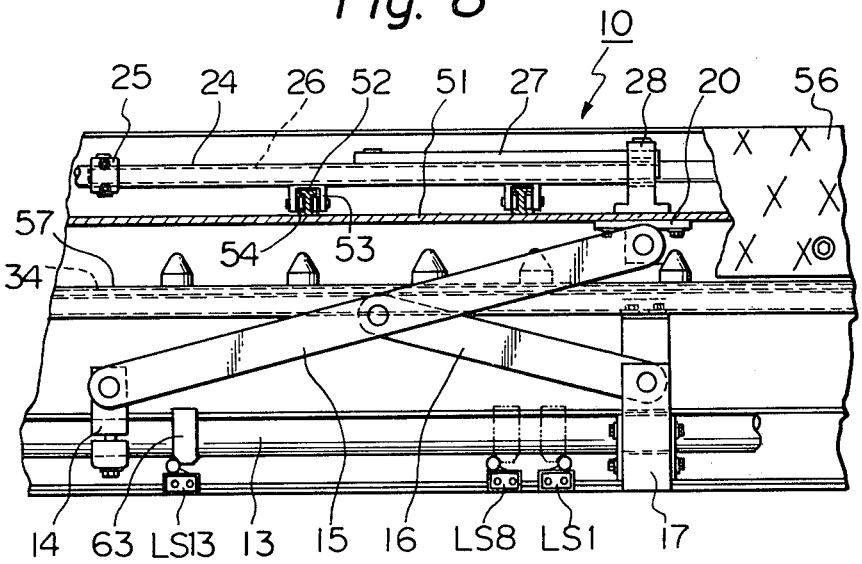
FIG. 8 is a partially enlarged view of FIG. 2.

Reference numeral 10 denotes a bobbin changing apparatus of the present invention which is fixed on the floor at a position in front of the fly frame 1 and which longitudinally extends along the fly frame 1. In FIG. 2, the bobbin changing apparatus 10 has a slide shaft 13 extending at the rear and lower portion thereof along the entire length thereof and slidably, but not rotatably, supported thereon. The slide shaft 13 is operatively connected to a motor 11 for vertical movement by means of a gear 12, so that as the motor 11 rotates forwardly or backwardly, the slide shaft 13 reciprocates longitudinally along the bobbin changing apparatus 10. As illustrated in FIGS. 2 and 8, the slide shaft 13 has a plurality of connecting members 14 secured thereto at a predetermined suitable interval along the axial direction thereof. Each of the connecting members 14 pivots the lower end of a driving link 15. The center of the driving link 15 is pivotally connected to one end of a driven link 16 by a pin, and the other end of the driven link 16 is pivotally connected to another connecting member 17 secured to the lower portion of the machine frame of the bobbin. changing apparatus 10. The length of the driven link 16 is equal to half the length of the driving link 15. As a result, a lifting means 19, comprising a plurality of so-called Scott-Russel's exact straight-line motion mechanisms, is obtained. Furthermore, the upper ends of the driving links 15 constituting the lifting means 19 are pivotally connected to brackets 20 by pins, which brackets are secured to a bobbin changing head 21 in order to support the head 21 in a horizontal plane, as will be explained later.

Figure 11:
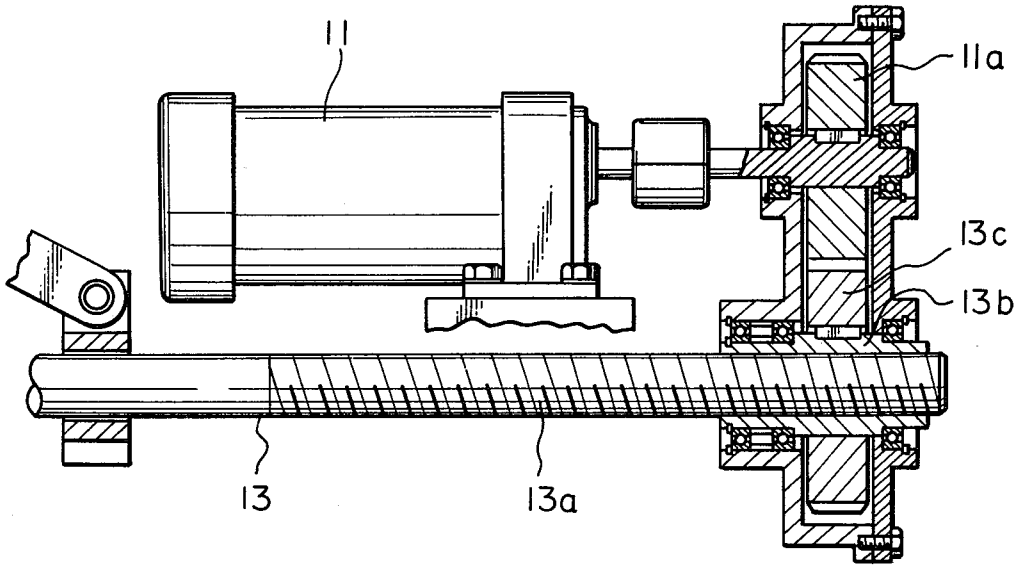
FIG. 11 is a partially cross sectioned view of a driving mechanism for a Scott-Russel's exact straight-line motion mechanism.

FIG. 11 illustrates an embodiment of a mechanism for converting the rotational movement of the motor 11 for vertical movement into the reciprocating movement of the slide shaft 13. As illustrated in FIG. 11, the output shaft of the motor 11 for vertical movement has a gear 11*a* secured thereto by a key, and the right end portion of the slide shaft 13 is formed in a male threaded portion 13*a* which engages with a nut 13*b* rotatably supported on the machine frame by a pair of bearings. The nut 13*b* is secured to a gear 13*c* by a key, which gear engages directly or through one or more intermediate gears (not shown) with the gear 11*a* secured to the motor 11 for vertical movement. In another embodiment, the nut 13*b* is integrally formed with the gear 13*c*. As a result of this construction, as the motor 11 for vertical movement rotates, the nut 13*b* is rotated by means of the gears 11*a* and 13*c*, and accordingly, the slide shaft 13 is moved to the right or to the left in accordance with the rotating direction of the nut 13*b*. In FIG. 8, due to the horizontal movement of the slide shaft 13, the connecting members 14 secured to the slide shaft 13 are also moved and change the inclination of the driving links 15 pivotted thereon. The bobbin changing head 21 connected to the driving links 15 are thus moved vertically via the Scott-Russel's exact straight-line motion mechanisms 18 as the motor 11 for vertical movement rotates forwardly or backwardly and the slide shaft 13 moves horizontally. The vertical movement of the bobbin changing head 21 is controlled, as will be explained later, by a plurality of limit switches LS1, LS8 and LS13 which are utilized to control the rotation of the motor 11 for vertical movement in a conventionally known manner in the technical field to which the present invention pertains, and, accordingly, further explanation is believed to be unnecessary except for the following. The slide shaft 13 has a dog 63 secured thereto which engages with the limit switch LS13 when the bobbin changing head 21 is at the lowermost position and engages with the limit switch LS1 when the bobbin changing head 21 is at the uppermost position. The limit switch LS8 engages with the dog 63 when the bobbin changing heads 21 are at a position appropriate for releasing bobbins from the bobbin changing head 21.

Figure 9:
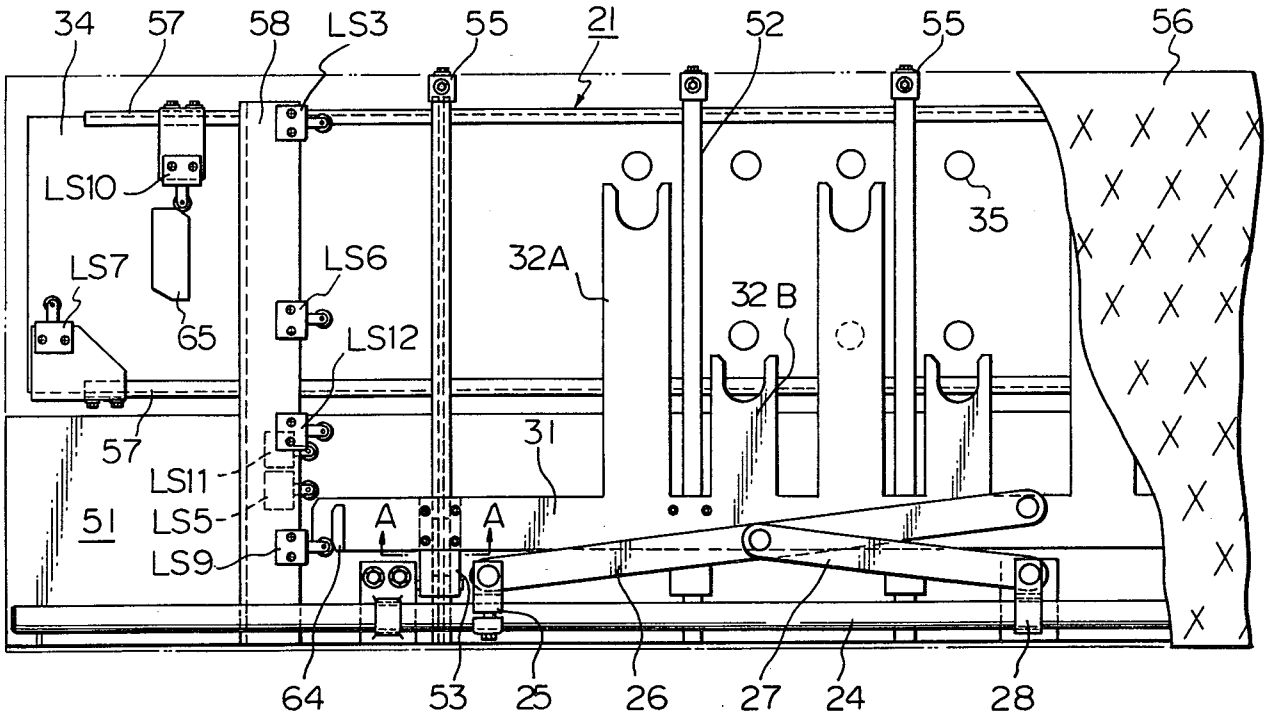
FIG. 9 is a partially enlarged view of FIG. 1, wherein a cover is removed in order to clarify the illustration.

In FIGS. 1 and 9, the bobbin changing head 21 is connected to the lifting means 19 (FIG. 2) and horizontally extends along the entire length of the bobbin changing apparatus 10. The bobbin changing head 21 has a slide shaft 24 capable of reciprocation in a longitudinal direction, but the shaft 24 is not permitted to rotate around its own longitudinal axis. The slide shaft 24 has a gear 23 secured thereto which is operatively connected to a motor 22 for horinzontal reciprocation (FIG. 1). The slide shaft 24 also has a plurality of connecting members 25 secured thereto at predetermined suitable intervals along the longitudinal direction thereof. Each connecting member 25 is connected pivotally to the rear end of a driving link 26. The center of the driving link 26 is pivotally connected to the one end of a driven link 27, the other end of which is pivotted to a bracket 28 secured to the bobbin changing head 21. The length of the driven link 27 is half that of the driving link 26. Thus, a horizontally reciprocating means comprising a plurality of so-called Scott-Russel's exact straight-line motion mechanisms 29 is arranged in a horizontal plane. The horizontally reciprocating means 30 has a connecting member 31, pivotted to the front ends of the driving links 26 by pins and extending in the entire length of the bobbin changing head 21. The connecting member 31 has two kinks of bobbin changing arms 32A and 32B horizontally projecting therefrom towards the fly frame 1. The two kinds of the bobbin changing arms 32A and 32B differ in their length and are alternately arranged. The bobbin changing arms 32A and 32B are positioned in a longitudinal direction of the fly frame 1 so that they exactly correspond to the bobbins 5 mounted on the fly frame 1. The front ends of the bobbin changing arms 32A and 32B have bobbin supporting parts, which are formed in a fork which can engage with the upper portions of the bobbins 5 in the embodiment illustrated in FIG. 9. In this case, it is preferable to ensure the holding of a bobbin and to prevent the swinging and deviation of a bobbin that a magnet or a sheet of magnetic rubber be adhered to the upper surface of the forked portion and that a piece of metal having ferromagnetic properties, such as an iron piece, be attached to a bobbin 5 just below the flange 5*a* formed at the top of the bobbin 5. Other embodiments of the bobbin supporting parts may be of the type by which the top of a bobbin is held as disclosed in Japanese Utility Model Publication No. 4750/65 and Japanese Patent Application Laid-open No. 89642/75.

Figure 7:
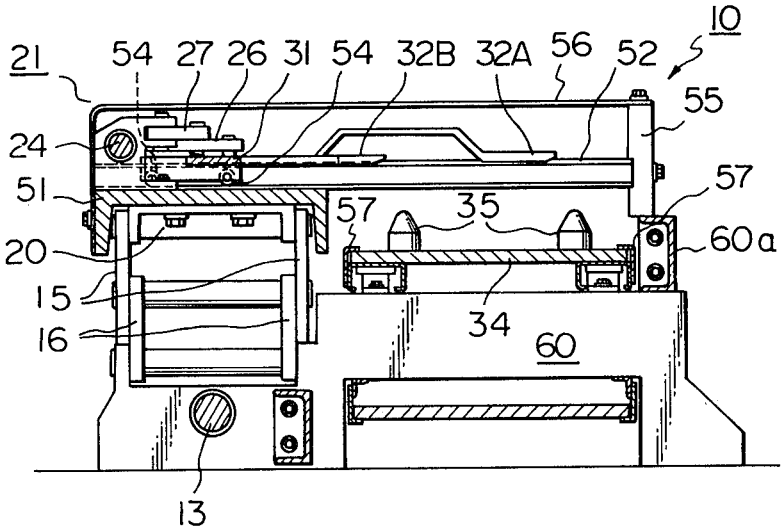
FIG. 7 is a partially enlarged view of FIG. 3.

As illustrated in FIG. 7, the bobbin changing head 21 is connected to the brackets 20 of the lifting means by threadedly fastening a member 51, for supporting the horizontally reciprocating means 30, extending in the longitudinal direction of the bobbin changing apparatus. The supporting member 51 supports the horizontally reciprocating means 30 and guide rails 52. One end of a cover 56, which covers the bobbin changing arms 32A and 32B located at the standby position, is secured to the supporting member 51 by means of bolts, and the other end of the cover 56 has a plurality of rod-like supports 55 attached thereto and corresponding to the guide rails 52. The supports 55 are connected to the front ends of the guide rails 52 and rest on beams 60*a* fixed on the machine frame 60 of the bobbin changing apparatus, when the bobbin changing head 21 is located at its lowermost position. Accordingly, at the lowermost position, the cover 56 is supported at its opposite ends in a so called beam manner, and therefore, it can withstand the weight of an operator. In short, the bobbin changing apparatus can be utilized as a footstool when the bobbin changing head is lowered to its lowermost position.

Figure 10:
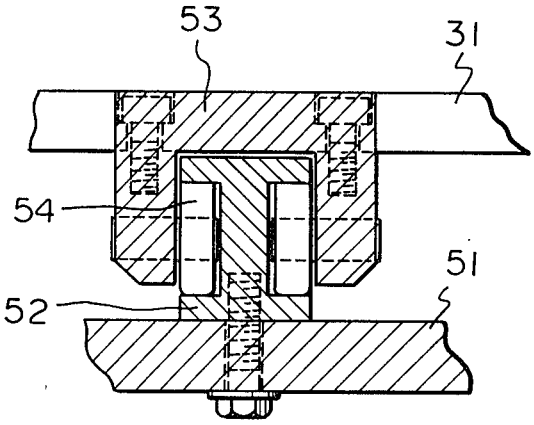
FIG. 10 is a cross sectional view taken along line A—A in FIG. 9.

As illustrated in FIGS. 9 and 10, U-shaped brackets 53 are attached to the connecting member 31 by means of bolts. Since each branched portion of each bracket 53 has two rollers 54 superposed in a direction perpendicular to the sheet on which FIG. 10 is illustrated, the bracket has four rollers 54 which roll along an I-shaped guide rail 52. Accordingly, the connecting member 31 can smoothly move backwardly, even when the bobbin changing arms 32A and 32B support full bobbins.

A mechanism similar to that illustrated in FIG. 11 is used to convert the rotational movement of the motor 22 (FIGS. 1 and 2), for horizontal reciprocation into the reciprocating movement of the slide shaft 24. Accordingly, the bobbin changing arms 32A and 32B operatively connected to the horizontally reciprocating means 30 via the connecting member 31 are horizontally reciprocated, i.e., advanced and retracted, by means of the slide shaft 24, which is reciprocated by the forward and backward rotation of the motor 22, as well as the Scott-Russel's exact straight-line motion mechanisms 29. In FIG. 9, the horizontal movement of the connecting member 31 provided with the bobbin changing arms 32A and 32B is controlled by energizing and deenergizing the motor 22 for horizontal reciprocation based on the signals emitted from limit switches LS3, LS5, LS9 and LS11 which are fixed on a plate 58 and which engage with a dog 64 secured to the connecting member 31 or the end of the connecting member 31. Especially, the limit switch LS3 emits a signal when the bobbin changing arms are located at their front ends. The limit switch LS9 emits a signal when the bobbin changing arms are located at their rear ends. The functions of the remaining limit switches LS5 and LS11 will be apparent according to the explanation which will be described later. The limit switches are connected to control means (not shown) in order to control the parts in accordance with a predetermined sequential program, which will be explained later with reference to the operation of the present bobbin changing apparatus. However, since the control technology is believed to be common to a person skilled in this technical field to which the present invention relates, a further explanation is omitted here.

As illustrated in FIG. 7, the bobbin changing apparatus has an endless conveyor 34 provided with pegs 35 for mounting empty bobbins and full bobbins. The conveyor 34 extends in the longitudinal direction of the bobbin changing apparatus 10 and is driven by an electric driving motor 33 (FIGS. 1 and 2). The pegs 35 are arranged in the front and back rows 36A and 36B (FIG. 1) extending in the longitudinal direction of the bobbin changing apparatus 10. A half of the pegs 35 are arranged corresponding to the zigzag arranged flyers, and the remaining half of the pegs are equally and longitudinally shifted from the other half of the pegs a predetermined certain distance P in one direction. The distance P is the same as the distance P in the fly frame 1. Therefore, the conveyor 34 can simultaneously carry full bobbins 9 and empty bobbins 5A (FIG. 4), the number of which is sufficient for one fly frame 1. The conveyor 34 is continuously or intermittently moved by means of the driving motor 33 so as to discharge the full bobbins 9 and to be supplied with the empty bobbins 5A. In addition, the conveyor 34 is reciprocated a length equal to one pitch while the bobbin changing arms 32A and 32B are advanced or retracted based on the signal emitted from limit switches LS6, LS7, LS10 and LS12 (FIG. 9). The limit switches LS7 and LS10 are secured to one 57 of the L-shaped plates (FIG. 7) which prevent a rising movement of the conveyor 34 and are engaged with a dog 65 attached to the conveyor 34. The limit switches LS6 and LS12 are fixed on the plate 58 (FIG. 9).

Figure 12A:
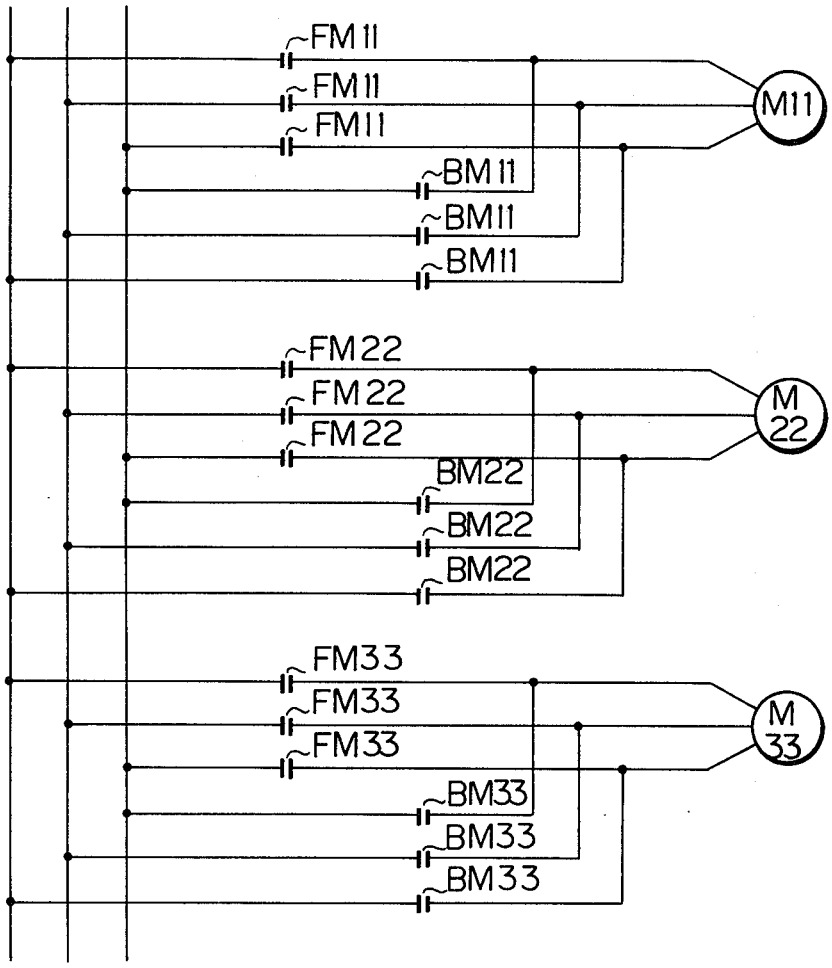
FIGS. 12A and 12B are circuit diagrams of a circuit for controlling the bobbin changing apparatus.
Figure 12B:
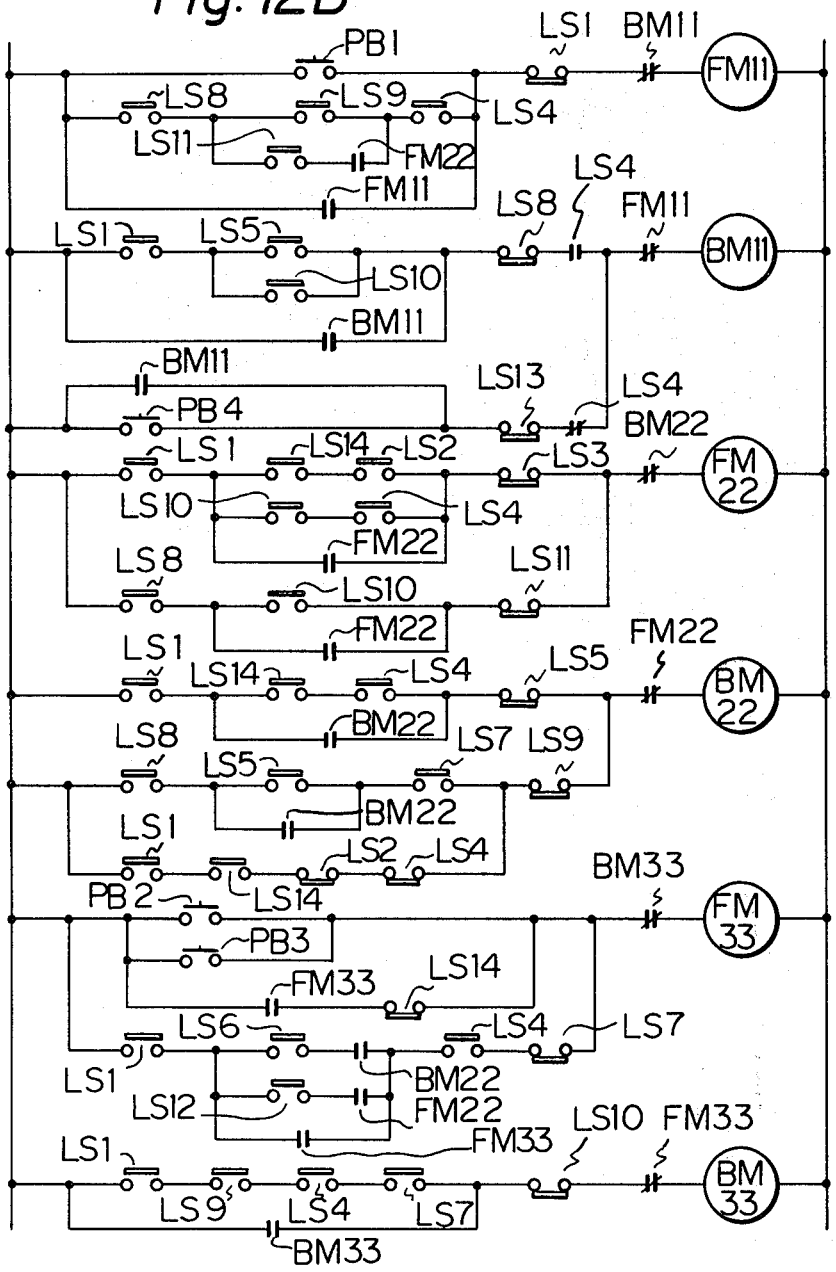

A circuit for controlling the bobbin changing apparatus 10 is illustrated in FIGS. 12A and 12B, wherein:

symbols M11, M22 and M33 enclosed by circles denote the motors 11, 22 and 33, respectively;

symbols FM11, FM22 and FM33 enclosed by circles denote coils of relays utilized to rotate the motors 11, 22 and 33 forwardly, and other symbols FM11, FM22 and FM33 denote contacts of the relays, respectively;

symbols BM11, BM22 and BM33 enclosed by circles denote coils of relays utilized to rotate the motors 11, 22 and 33 backwardly, and other symbolS BM11, BM22 and BM33 denote contacts of the relays, respectively;

symbol LS1 denotes a contact of the limit switch LS1 emitting a signal that the bobbin changing head 21 is at its uppermost position;

symbol LS2 denotes a contact of a limit switch LS2 utilized to detect that the bobbin rail 6 is at its intermediate position;

symbol LS3 denotes a contact of the limit switch LS3 emitting a signal that the bobbin changing arms 32A and 32B are their farthest advanced end;

symbol LS4 denotes a contact of a limit switch LS4 utilized to detect that the bobbin rail 6 is at its lowermost position;

symbol LS5 denotes a contact of the limit switch LS5 utilized to know that the bobbin changing arms 32A and 32B are at a position corresponding to the pegs 35 mounted on the conveyor 34 while the arms are retracted;

symbol LS6 denotes a contact of the limit switch LS6 which emits a signal starting a one pitch forward movement of the conveyor 34 when the bobbin changing arms 32A and 32B with full bobbins are retracted to a predetermined position;

symbol LS7 denotes a contact of the limit switch LS7 which detects that the conveyor 34 has moved a one pitch distance;

symbol LS8 denotes a contact of the limit switch LS8 which emits a signal that the bobbin changing arms 32A and 32B correspond the pegs 35 mounted on the conveyor 34;

symbol LS9 denotes a contact of the limit switch LS9 which emits a signal when the bobbin changing arms 32A and 32B are their backwardmost position;

symbol LS10 denotes a contact of the limit switch LS10 which emits a signal when the conveyor 34 moves a one pitch distance backwardly;

symbol LS11 denotes a contact of the limit switch LS11 utilized to know that the bobbin changing arms 32A and 32B are at a position corresponding to the pegs 35 mounted on the conveyor 34 while the arms are advanced;

symbol LS12 denotes a contact of the limit switch LS12 which emits a signal starting a one pitch forward movement of the conveyor 34 when the bobbin changing arms 32A and 32B with empty bobbins are advance to a predetermined position;

symbol LS13 denotes a contact of the limit switch LS13 which emits a signal when the bobbin changing head 21 is at its lowermost position;

symbol LS14 denotes a contact of a limit switch LS14 which emits a signal when the supply of empty bobbins to the pegs 35 of the conveyor 34 is completed;

symbol PB1 denotes a contact which is closed when the supply of empty bobbins to the pegs 35 of the conveyor 34 is started;

symbol PB2 denotes a contact which is closed when the discharge of the full bobbins mounted on the conveyor 34 is started;

symbol PB3 denotes a contact which emits a signal a predetermined time interval before the winding of roving onto bobbins is completed; and symbol PB4 denotes a contact which emits a signal when the conveyor 34 completes the discharge of the full bobbins.

Figure 5:
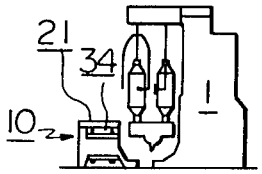
FIGS. 5(1) through 5(18) are side views for sequentially illustrating the bobbin changing operations of the fly frame and the bobbin changing apparatus.
Figure 5:
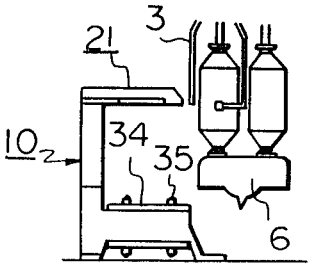
Figure 5:
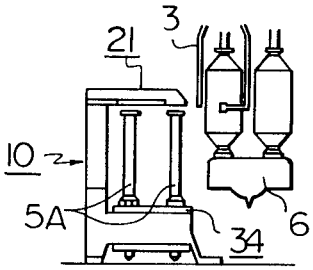
Figure 5:
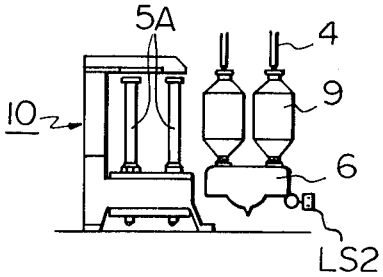
Figure 5:
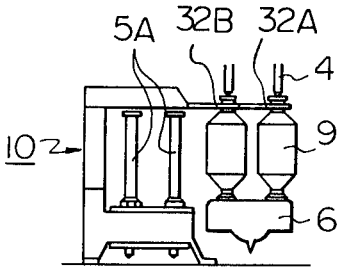
Figure 5:
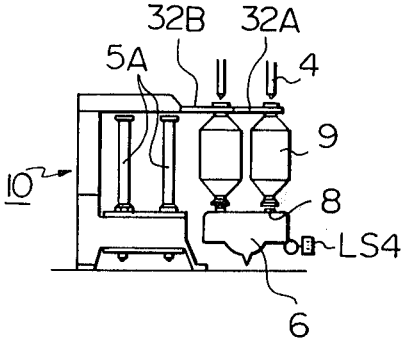
Figure 5:
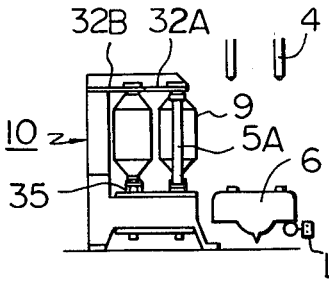
Figure 5:
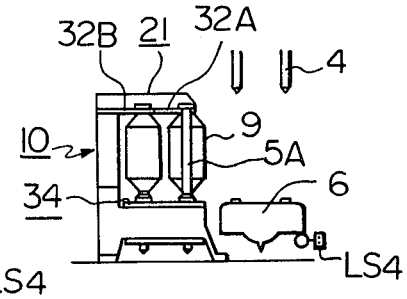
Figure 5:
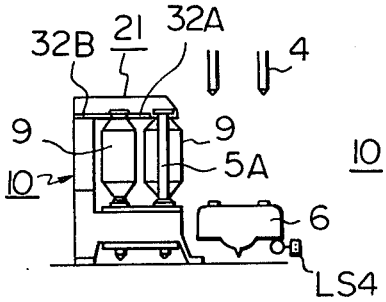
Figure 5:
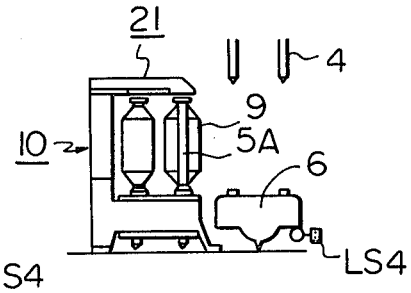
Figure 5:
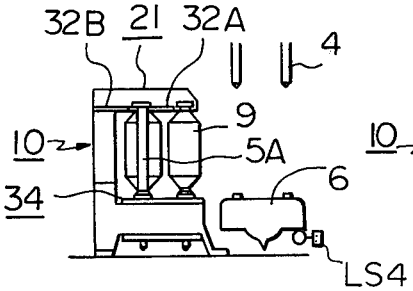
Figure 5:
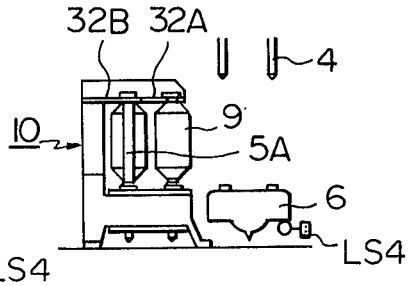
Figure 5:
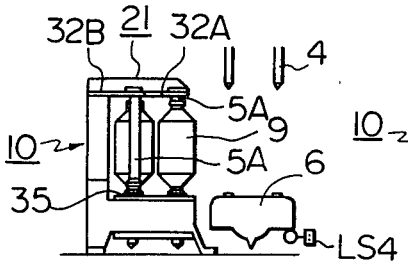
Figure 5:
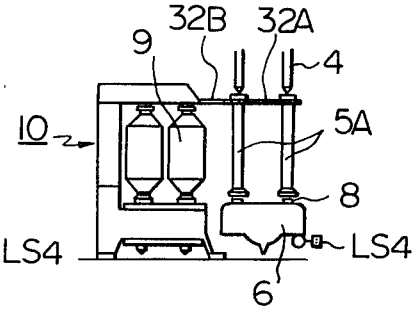
Figure 5:
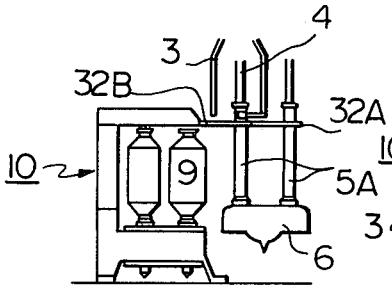
Figure 5:
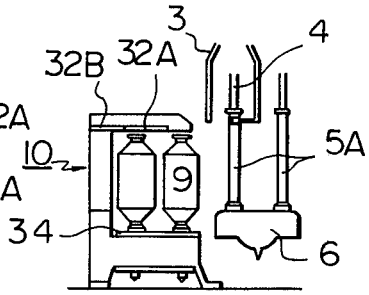
Figure 5:
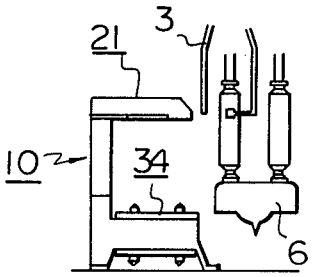
Figure 5:
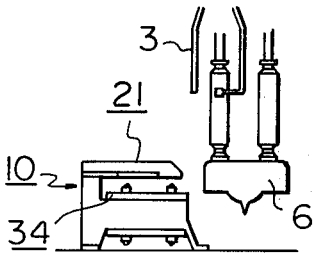
Figure 6:
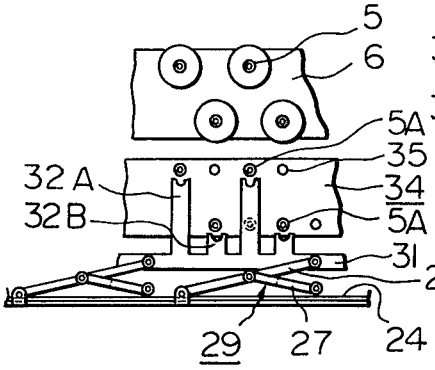
FIGS. 6(1) through 6(9) are plan views for sequentially illustrating the operations of the bobbin changing apparatus.
Figure 6:
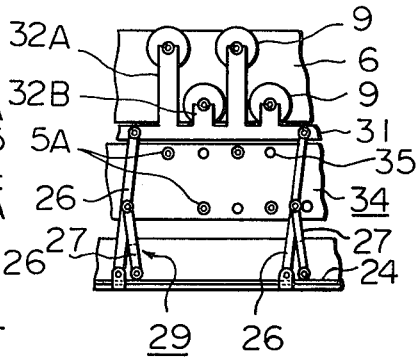
Figure 6:
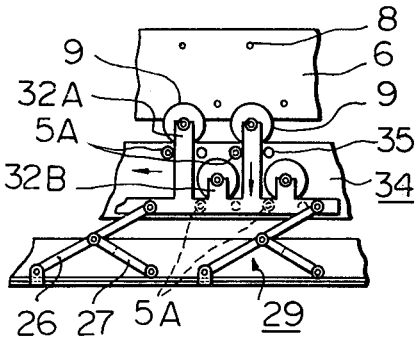
Figure 6:
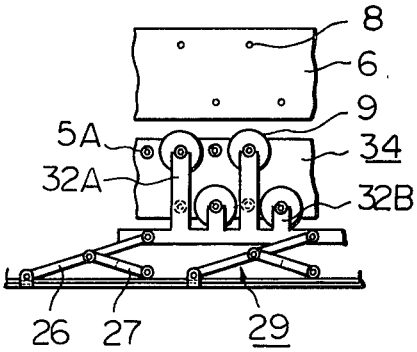
Figure 6:
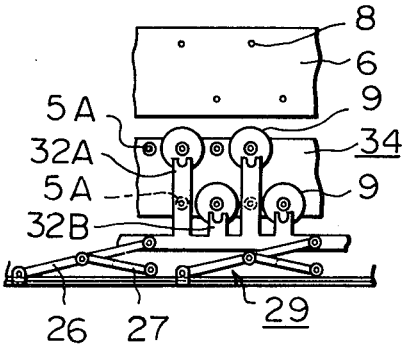
Figure 6:
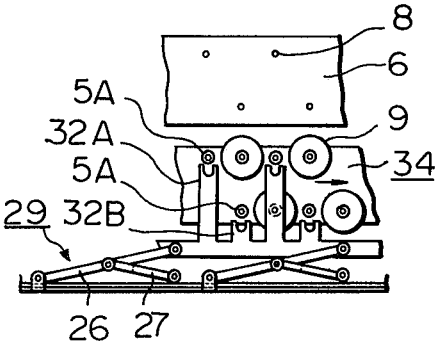
Figure 6:
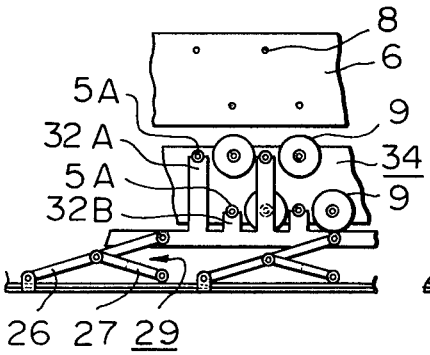
Figure 6:
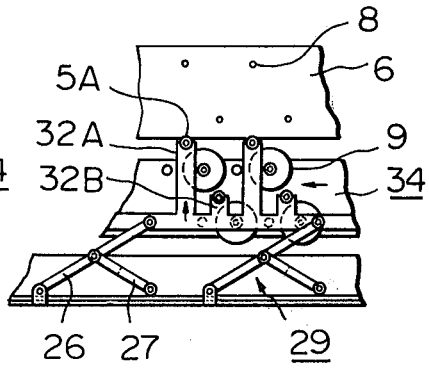
Figure 6:
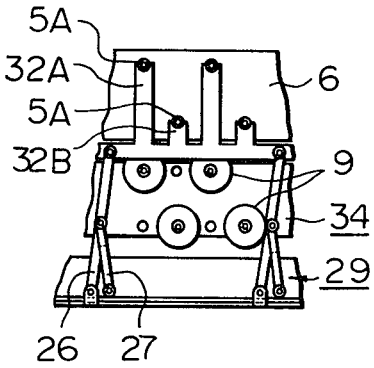
Figure 6:
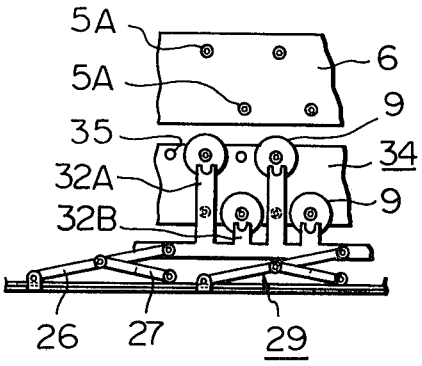

The operation of the present embodiment will now be described with reference to FIGS. 5(1) through 5(18) and 6(1) through 6(9). During the normal operation of the fly frame 1, as illustrated in FIG. 5(1), the bobbin changing head 21 of the bobbin changing apparatus 10 is kept at its lowermost position where it is located near the conveyor 34. Thereafter, when the winding of the bobbins on the fly frame 1 is almost completed, a signal is emitted from a switch PB1 (not shown), well known in this technical field, and the motor 11 for vertical movement is forwardly rotated and accordingly, the lifting means 19 is actuated and the bobbin changing head 21 is lifted from the lowermost position illustrated in FIG. 5(1) to the uppermost position illustrated in FIG. 5(2). At this time, the dog 63 secured to the slide shaft 13(FIG. 8) comes into abutment with the limit switch LS1 which stops the foward rotation of the motor 11. The signal emitted from a manually operated switch PB3 starts the rotation of the motor 33 forwardly, and accordingly, the conveyor 34 is continuously moved. At one end of the bobbin changing apparatus 10, every other peg 35 arranged on the conveyor in the front and back rows 36A and 36B are supplied with empty bobbins 5A so that the empty bobbins 5A are mounted on the belt conveyor 34 in a zigzag fashion, and the empty bobbins 5A are successively transferred toward the other end of the bobbin changing apparatus 10. When empty bobbins 5A, the number of which is equal to that of the flyers 3 arranged on the fly frame 1, are mounted on the conveyor 34 and are located corresponding to bobbins 5 on the fly frame as illustrated in FIG. 6(1), a dog (not shown) attached to the conveyor comes into abutment with the limit switch LS14, and the motor 33 is stopped and the conveyor 34 is also stopped.

Thereafter, when the winding of roving on bobbins is completed and full bobbins are formed, a counter (not shown) emits a full bobbin signal to stop the normal operation of the fly frame 1 and lowering the bobbin rail 6 in a conventionally well known manner. When the bobbin rail 6 comes into abutment with a limit switch LS2(FIG. 5(4)) attached to the fly frame 1, the lowering movement of the bobbin rail 6 is stopped. As a result, the bobbin rail 6 stops at an intermediate position where the full bobbins 9 mounted on the bobbin rail 6 slightly engage with the lower ends of the bobbin guide legs 4 of the flyers 3.

A signal emitted from the limit switch LS2 or another suitable means is input to forwardly rotate the motor 22 for horizontally reciprocating the connecting member 31. Accordingly, the slide shaft 24 of the horizontally reciprocating means 30 is slid, and therefore, the bobbin changing arms 32A and 32B are advanced from their standby position illustrated in FIGS. 5(4) and 6(1) to the full bobbins 9 formed on the fly frame 1. At their front ends, the forks of the bobbin changing arms 32A and 32B are inserted onto the upper portions of the full bobbins as illustrated in FIGS. 5(5) and 6(2), and there, the dog 64 attached to the connecting member 31 comes into abutment with the limit switch LS3 (see FIG. 9), a signal from which is input to stop the forward rotation of the motor 22.

Therefore, based on a signal emitted from the limit switch LS3 or another suitable means and input to the fly frame controlling means (not shown), the bobbin rail 6 is lowered until it comes into abutment with a limit switch LS4 (FIG. 5(6)). The full bobbins 9 formed on the bobbin rail 6 are commenced to be lowered together with the bobbin rail 6, and when the full bobbins 9 are lowered a short distance, their upper portions are released from the bobbin guide legs 4 of the flyers 3. Accordingly, the flanges 5*a* of the full bobbins 9 are suspended from the bobbin changing arms 32A and 32B. The bobbin rail 6 is further lowered until it is located at the lowermost position (FIG. 5(6)) where the projecting portions 8 of the bobbin wheels 7 are disengaged from the full bobbins 9.

In another embodiment, instead of lowering the bobbin rail 6, the bobbin changing arms 32A and 32B are lifted a short distance together with the full bobbins 9 in order to disengage the full bobbins 9 from the projecting portions of the bobbin wheels 7.

When the limit switch LS4 is actuated, the motor 22, for horizontally reciprocating the connecting member of the bobbin changing apparatus 10, is backwardly rotated. Accordingly, the slide shaft 24 is slid, and the bobbin changing arms 32A and 32B suspending full bobbins begin retracting from the front end position. During the retracting movement of the bobbin changing arms 32A and 32B, the limit switch LS6 (FIG. 9) is actuated by the dog 64 attached to the connecting member 31, and a signal emitted from the limit switch LS6 rotates the motor 33 so as to move forwardly the conveyor 34 a distance equal to one pitch P, i.e., from the position illustrated in FIG. 6(2) to the position illustrated in FIG. 6(4), until the dog 65 attached to the conveyor 34 comes into abutment with the limit switch LS7. The bobbin changing arms 32A and 32B may either temporarily stop or continue the retracting movement from the time when the limit switch LS6 is actuated to the time when the limit switch LS7 is actuated. A signal emitted from the limit switch LS7 is input to stop the rotation of the motor 33. Accordingly, because of the combination of the retracting movement of the bobbin changing arms 32A and 32B with the movement of the conveyor 34 in a direction perpendicular to the movement of the bobbin changing arms, the full bobbins 9 suspended from the bobbin changing arms 32A and 32B pass through spaces between adjacent empty bobbins which are arranged in a zigzag fashion on the conveyor 34 (FIG. 6(3)) and are transferred to a position above the empty pegs of the conveyor 34 (see FIGS. 5(7) and 6(4)). Then, the end of the connecting member 31 comes into abutment with the limit switch LS5 (FIG. 10), which transmits a signal to stop the backward movement of the motor 22 and to rotate the motor 11 backwardly. Thus, the bobbin changing head 21 is lowered by actuation of the lifting means 19 from the uppermost position to a position where the dog 63 attached to the slide shaft 13 comes into contact with the limit switch LS8, so that the full bobbins suspended from the changing head 21 are inserted onto the corresponding empty pegs 35 mounted on the conveyor 34 (see FIG. 5(8)). When the limit switch LS8 is actuated, the rotation of the motor 11 for vertical movement is stopped, and the motor 22 is again rotated to move the connecting member 31 together with the bobbin changing arms 32A and 32B backwardly until the dog 64 attached to the connecting member 31 comes into abutment with the limit switch LS9 (see FIGS. 5(9) and 6(5)). After the forks formed at the front ends of the bobbin changing arms 32A and 32B are separated from the full bobbins 9, the motor 11 is rotated forwardly based on the signal emitted from the limit switch LS9, so that the bobbin changing head 21 is again lifted to the uppermost position and so that the bobbin changing arms 32A and 32B return to their standby position (see FIG. 5(10)). When the bobbin changing arms 32A and 32B stop at their standby position, the limit switch LS1 is actuated, and the rotation of the motor 11 is stopped. When the bobbin changing arms 32A and 32B return to their uppermost position and the limit switch LS1 is actuated, the conveyor 34 is moved backwardly a distance equal to one pitch P between pegs 35, i.e., from a position illustrated in FIG. 6(5) to a position illustrated in FIG. 6(6) by way of the backward rotation of the motor 33 until the dog 65 attached to the conveyor 34 comes into abutment with the limit switch LS10. Thus, the empty bobbins 5A mounted on the conveyor 34 correspond to the bobbin changing arms 32A and 32B (FIG. 6(6)). When the limit switch LS10 is actuated, the motor 11 is moved backwardly so that the bobbin changing head 21 is lowered from the uppermost position to a position where the dog 63 secured to the slide shaft 13 comes into abutment with the limit switch LS8 (FIG. 5(11)). Then the motor 11 stops, and the motor 22 is rotated based on a signal emitted from the limit switch LS8. Accordingly, the bobbin changing arms 32A and 32B are advanced, and the forks formed at the front ends of the bobbin changing arms 32A and 32B are inserted onto the upper portions of the corresponding empty bobbins 5A (FIGS. 5(12) and 6(7)). Then, the end of the connecting member 31 comes into abutment with the limit switch LS11. A signal emitted from the limit switch LS11 is input to begin the rotation of the motor 11 which causes the further lifting of the bobbin changing head 21 until the dog 63 secured to the slide shaft 13 comes into abutment with the limit switch LS1. Accordingly, the empty bobbins 5A mounted on the pegs 35 of the conveyor 34 are removed therefrom and are suspended from the bobbin changing arms 32A and 32B (FIG. 5(13)). Since the motor 22 continues to rotate forwardly, the bobbin changing arms 32A and 32B are advanced from a position, where the empty bobbins 5A are removed from the pegs 35, to the fly frame 1. During the advancement of the bobbin changing arms 32A and 32B, the limit switch LS12 is actuated by the dog 64 secured to the connecting member 31. The signal emitted from the limit switch LS12 is input to move the conveyor 34 a distance equal to one pitch P between the pegs 35 mounted on the conveyor 34, i.e., from a position illustrated in FIG. 6(7) to a position illustrated in FIG. 6(9). The rotation of the motor 33 is stopped when the dog 65 comes into abutment with the limit switch LS7. The bobbin changing arms 32A and 32B may either temporarily stop or continue the advancing movement from the time when the limit switch LS12 is actuated to the time when the limit switch LS7 is actuated. Because of the combination of the advancement of the bobbin changing arms 32A and 32B with the movement of the conveyor 34 in a direction perpendicular thereto, the empty bobbins 5A suspended from the bobbin changing arms 32A and 32B can pass through spaces between adjacent full bobbins 9 mounted in zigzag fashion on the conveyor 34 (FIG. 6(8)) and reach a position above the bobbin rail 6 of the fly frame 1. At the advancing end, the dog 64 comes into abutment with the limit switch LS3 and stops the motor 22. In addition, at the advancing end, the empty bobbins 5A suspended from the bobbin changing arms 32A and 32B correspond to both the projecting portions 8 of the bobbin wheels 7 and the bobbin guide legs 4 of the flyers 3 (FIG. 5(14) and FIG. 6(9)). Then, as the bobbin rail 6 which has been at the lowermost position begins to lift based on a suitable signal received by the fly frame controlling means, the projecting portion 8 of the bobbin wheels 7 are inserted into the lower portions of the holes formed in the empty bobbins 5A so as to push up the empty bobbins 5A. Thus, the upper portions of the holes formed in the empty bobbins 5A are similarly inserted onto the bobbin guide legs 4. Accordingly, the empty bobbins 5A are supported by their upper and lower portions, and the doffing and donning operation is completed.

Then, the bobbin rail 6 stops at its initial winding position (FIG. 5(15)). The bobbin changing arms 32A and 32B which have been at their advancing end are retracted to the standby position by rotating the motor 22 backwardly based on a suitable signal emitted from not-illustrated control means, after the empty bobbins 5A are supported by their upper and lower portions.

When the bobbin changing arms 32A and 32B return to their standby position, the re-operation of the fly frame starts (FIGS. 5(16) and 6(10)). After the restarting of the fly frame 1, the conveyor 34 of the bobbin changing apparatus is turned based on a signal from a switch PB2 so that the doffed full bobbins are discharged outwards (FIG. 5(17)). After the full bobbins 9 are discharged, a signal is emitted from a switch PB4, and the motor 11 is rotated backwardly based on the signal so that the bobbin changing head 21 of the bobbin changing apparatus 10 is lowered to the lowermost position (FIG. 5(18)). After the bobbin changing head 21 returns its lowermost position, the height of the bobbin changing apparatus is low enough to use the upper surface thereof as a footstool.

The bobbin changing apparatus 10 of the above-explained embodiment is installed in front of the fly frame 1, and the bobbin changing head 21 is vertically movable and rests on the beam 60*a* when the bobbin changing head 21 is located at the lowermost position. Therefore, the bobbin changing apparatus 10 is able to be utilized during the operation of the fly frame as a footstool which is convenient for the operator. Further, the bobbin changing apparatus 10 can be located adjacent to the fly frame, so that the space for the installation of the bobbin changing apparatus can be decreased.

In accordance with the above-mentioned embodiment, the lifting means 19 and the horizontally reciprocating means 30 respectively comprise the Scott-Russel's exact straight-line motion mechanisms. However, said means 19 and 30 of the present invention are not limited to the above-mentioned embodiment, and an appropriate mechanism can be adopted to reciprocate the bobbin changing arms over a given stroke in the vertical direction or in the horizontal direction.

According to the present invention, when a bobbin changing operation is carried out in a fly frame wherein flyers supported from above are arranged in a zigzag fashion in front and back rows extending in the longitudinal direction of the fly frame, empty bobbins are supplied in a zigzag fashion on a conveyor of the bobbin changing apparatus. In spite of the zigzag fashion of both the empty bobbins and the flyers, i.e., the full bobbins on the fly frame, the bobbin changing operation can be smoothly and simultaneously carried out without collision or interference between the full bobbins and the empty bobbins. The empty bobbins can be mounted on the fly frame just subsequent to the doffing operation of the full bobbins. The doffed full bobbins placed on the conveyor can be discharged from the bobbin changing apparatus during the operation of the fly frame, and as a result, not only the bobbin changing operation is carried out automatically, but also the length of time necessary for the bobbin changing operation is reduced, so that the length of time necessary for stopping the fly frame is greatly decreased. Consequently, production efficiency is greatly enhanced.

In the above-described embodiment, the pitches between adjacent flyers in the fly frame were not exactly the same. In other words, there were two pitches P and P'. However, the present invention is also applicable to a fly frame wherein all the flyers are equidistantly arranged. In this case, a conveyor provided with pegs may be moved unidirectionally throughout the doffing and donning operation.

I claim:

1. Method for simultaneously changing bobbins in a fly frame wherein flyers supported from above are arranged in a zigzag fashion in front and back rows extending in the longitudinal direction of said fly frame, which method comprises: supplying empty bobbins in a zigzag fashion on pegs mounted on a conveyor of a bobbin changing apparatus before stoppage of said fly frame upon completion of full bobbins; advancing bobbin changing arms of said bobbin changing apparatus from a standby position thereof to full bobbins on the fly frame after the stoppage of said fly frame; simultaneously doffing said full bobbins by said bobbin changing arms; retracting said bobbin changing arms with said full bobbins and moving said conveyor so as to pass said full bobbins through spaces between adjacent empty bobbins; inserting said full bobbins onto empty pegs of the conveyor; moving said conveyor to locate said empty bobbins at positions corresponding to said bobbin changing arms; advancing said bobbin changing arms to remove said empty bobbins from said pegs; further advancing said arms with said empty bobbins toward the fly frame and moving said conveyor so as to pass said empty bobbins through spaces between adjacent full bobbins on the conveyor; donning said empty bobbins on said fly frame; and retracting said arms to said standby position.

2. Method according to claim 1, wherein the full bobbins doffing step comprises supporting said full bobbins by said bobbin changing arms and lowering a bobbin rail of said fly frame.

3. Method according to claim 1, wherein said zigzag supplied empty bobbins on said conveyor correspond to said zigzag arranged full bobbins on said fly frame, and said conveyor is moved one pitch length between adjacent pegs when said bobbin changing arms with full bobbins are retracted.

4. Method according to claim 3, wherein said conveyor is moved one pitch length between adjacent pegs when said bobbin changing arms with the empty bobbins are advanced.

5. Method according to claim 1, wherein the empty bobbins donning step comprises locating said empty bobbins at positions between guide legs of the flyers and projecting portions of bobbin wheels and lifting the bobbin rail of said fly frame.

6. Method according to claim 1, which further comprises continuously moving said conveyor, on which the full bobbins are mounted, to discharge said full bobbins, outward from said bobbin changing apparatus.

7. Apparatus for simultaneously changing bobbins in a fly frame, wherein flyers are arranged in a zigzag fashion in front and back rows extending in the longitudinal direction of said fly frame, which apparatus comprises: bobbin changing arms having bobbin supporting parts at the free ends thereof, said bobbin supporting parts being arranged in a zigzag fashion corresponding to said zigzag arranged flyers; a connecting member for supporting all of said bobbin changing arms; reciprocation means for horizontally reciprocating said connecting member towards said fly frame and therefrom; lifting means for lifting said connecting member; a conveyor located under said bobbin changing arms at a standby position and having two rows of pegs, half of said pegs being arranged corresponding to the zigzag arranged flyers, and the remaining half of said pegs being equally and longitudinally shifted from the other half of said pegs a predetermined certain distance in one direction; conveyor moving means for moving said conveyor to and fro; means for controlling said lifting means; and means for controlling the cooperative movements of said reciprocating means with said conveyor moving means so as to pass bobbins supported by said bobbin changing arms through spaces between adjacent bobbins mounted on said pegs of said conveyor.

8. Apparatus according to claim 7, wherein said bobbin changing arms are formed as one-piece with said connecting member.

9. Apparatus according to claim 7 further comprising a cover for covering said bobbin changing arms, said cover being fixed to said lifting means and the free end thereof near the fly frame resting on a frame of the bobbin changing apparatus when said connecting member is lowered.

10. Apparatus according to claim 7 further comprising guide rails extending laterally and horizontally for guiding said connecting member when said connecting member is advanced foward and is retracted from said fly frame.

11. Apparatus according to claim 7, wherein said reciprocating means comprises Scott-Russel's exact straight-line motion mechanisms.

12. Apparatus according to claim 7, wherein said lifting means comprises Scott-Russel's exact straight-line motion mechanisms.

13. Apparatus according to claim 7, wherein said bobbin supporting parts of said bobbin changing arms are forked, a magnetic member is adhered to the upper surface of each forked portion, and a piece of metal having ferromagnetic properties is attached to the top portion of the bobbin.

* * * * *